United States Patent [19]

Inoue et al.

[11] 4,382,718

[45] May 10, 1983

[54] VERTICALLY MOVABLE MARINE WORKING PLATFORM STRUCTURE HAVING VERTICALLY MOVABLE GROUNDABLE SUPPORT FRAMES

[75] Inventors: Takehisa Inoue; Shigeru Koshikawa, both of Tamano, Japan

[73] Assignee: Mitsui Engineering & Shipbuilding Co., Ltd., Tokyo, Japan

[21] Appl. No.: 221,339

[22] Filed: Dec. 30, 1980

[30] Foreign Application Priority Data

May 20, 1980 [JP] Japan ..... 55-67553

[51] Int. Cl.[3] ..... E02B 17/00

[52] U.S. Cl. ..... 405/196; 405/203; 405/204

[58] Field of Search ..... 405/196, 197, 195, 198–208, 405/224; 254/105, 106, 107, 112

[56] References Cited

U.S. PATENT DOCUMENTS

| | | | |
|---|---|---|---|
| 2,970,446 | 2/1961 | Suderow | 405/196 |
| 3,183,676 | 5/1965 | LeTourneau | 405/196 |
| 3,201,945 | 8/1965 | Sutton | 405/196 |
| 3,628,336 | 12/1971 | Moore | 405/196 |

*Primary Examiner*—Dennis L. Taylor

*Attorney, Agent, or Firm*—Armstrong, Nikaido, Marmelstein & Kubovcik

[57] ABSTRACT

A vertically movable, offshore working platform structure is disclosed, which includes a working platform vertically movably mounted on parallel arranged support frames individually comprising a plurality of parallel disposed vertically elongate cords connected altogether to a support frame assemblage by horizontal members and diagonal members having their ends secured to the cords at panel point portions of the cords, and which also includes guides for the vertical movement thereof which individually have a length at least great enough to extend between two longitudinally adjacent panel point portions of respective cords. The guides of the working platform being of such a relatively great length as above, horizontal forces to be applied by the guide onto the support frame are centralized in their application mainly upon panel point portions to thereby realize that the horizontal forces being born in substantially even portions by respective cords through horizontal members and diagonal members, concentration of loads is avoided upon that portion of respective cords which lies between two longitudinally adjacent panel point portions.

4 Claims, 8 Drawing Figures

VERTICALLY MOVABLE MARINE WORKING PLATFORM STRUCTURE HAVING VERTICALLY MOVABLE GROUNDABLE SUPPORT FRAMES

BACKGROUND OF THE INVENTION

1. Field of the Invention

The present invention relates to a vertically movable, marine working platform structure having vertically movable, groundable support frames and, more particularly, to a vertically movable, marine working platform structure having vertically movable, groundable support frames, which withstands external horizontal forces, such as the forces of wind and waves while the working platform structure is in tow or in grounding and setting-up operations or at work in spite of the weight-reduced support frames.

2. Description of the Prior Art

With a vertically movable, offshore working platform structure having vertically movable, groundable support frames, it is operated that while it is towed, the working platform itself is floated on the surface of the sea with the support frames maintained in a raised position, and when it is at work, the support frames are lowered into the sea water in a manner such that the structure is grounded on the sea bed and keeps standing by itself.

The material for and the sizes of the above working platform structure including the support frames are determined such that the working platform structure withstands preselected natural conditions while it is in tow or in grounding and setting-up operations or at work. Especially, when such a working platform structure is used for submarine oil field probes, it is necessary that the structure be made of a specially selected material to specially selected dimensions. Accordingly, the greater part of a working platform structure of this kind generally consists of high tension steel. Above all, the support frames consist of high tension steel of the highest grade. Under the circumstances, a great deal of effort is now going into the reduction of the weight of the support frames.

Each of the support frames consists of a plurality of cords arranged vertically in parallel with one another, a plurality of horizontal members both ends of each of which are joined to panel point portions of the cords, and a plurality of diagonal members both ends of each of which are joined to the panel point portions of the cords, therefore an utmost safety is obtainable when a guide provided to the working platform is situated at a point substantially corresponding to the location of the panel point portion of the cord. It then is that horizontal forces to be transmitted from the guide to the support frame can concentrate mainly onto the panel point portion and can be born substantially evenly by respective cords of the support frame through horizontal members and diagonal members, whereby concentration of loads can be effectively avoided upon the portion of the cord lying between two longitudinally adjacent panel point portions of the cord. On the other hand, when the guide is situated at an intermediate point on the cord lying between two longitudinally adjacent panel point portions, loads can tend to concentrate at such point on the cord, whereby a most dangerous condition can arise. Therefore, when the working platform structure is overtaken by a storm while it is being grounded and set up, the working platform is vertically moved so as to be retired to a safe place where the guide is in alignment with panel point portions of the same level of a support frame. However, the positions of foot cans attached to the lower ends of support frames are not in agreement with one another in practice with respect to the vertical axis of the working platform structure due to (a) the inclination of the surface of the sea bottom, (b) lack of uniformity of geologic formation in such portions of the sea bottom which are just under and around the foot cans and (c) unbalanced loads applied to the foot cans. On the other hand, it is necessary that a working platform be kept substantially horizontal. Consequently, with use of such a guide as being shorter than the distance between two vertically adjacent panel point portions of the cord, it practically is difficult to adjust the position of the working platform such that the guide is, in position, in alignment with the panel point portion.

SUMMARY OF THE INVENTION

An object of the present invention is to provide a vertically movable, marine working platform structure having vertically movable, groundable support frames, which permits a guide provided in a working platform to come into alignment with panel point portions of the same level of the support frames under any circumstances.

Another object of the present invention is to reduce the weight of support frames of a marine working platform structure, and thereby cut down the cost of manufacturing the structure.

In order to achieve the above objects, the present invention provides a vertically movable, marine working platform structure having vertically movable, groundable support frames, comprising a working platform; a plurality of groundable support frames each of which consists of a plurality of cords arranged vertically in parallel with one another, a plurality of horizontal members both ends of each of which are joined to panel point portions of the cords, and a plurality of diagonal members both ends of each of which are joined to the panel point portions of the cords, each of the support frames being vertically movably fastened to the working platform; and support frame-holding guides provided in the working platform and having a length at least greater than the distance between two vertically adjacent panel point portions of the cords.

The above and other objects as well as the advantageous features of the invention will become apparent from the following description of the preferred embodiments taken in conjunction with the accompanying drawings.

DETAILED DESCRIPTION OF PREFERRED EMBODIMENTS

Figure 1:
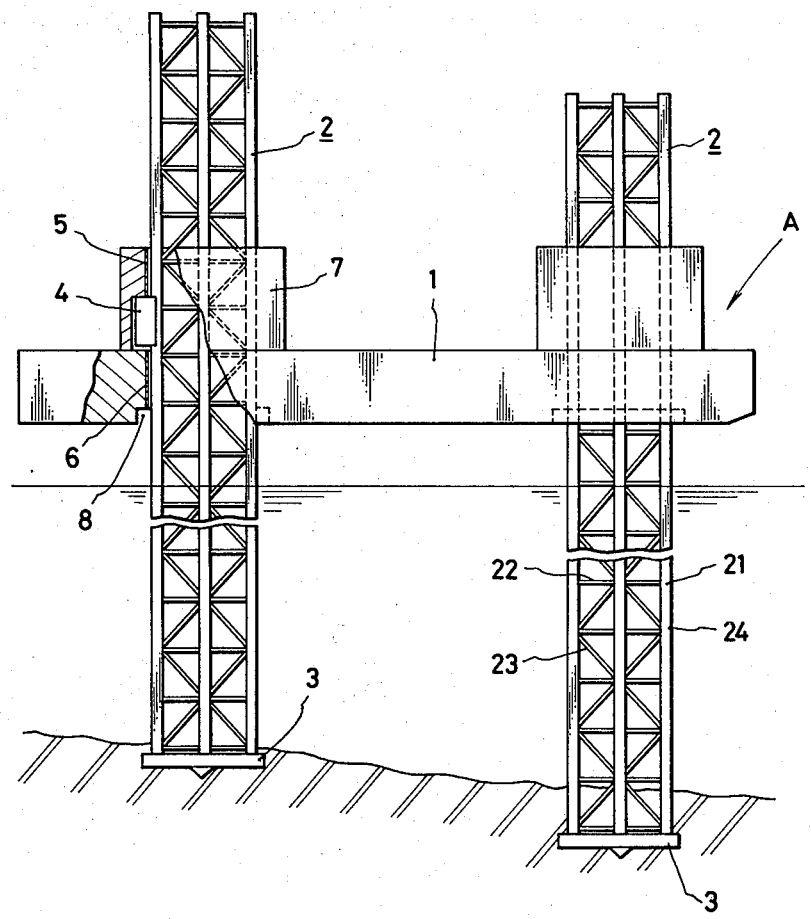
FIG. 1 is a side elevational view partially in section of a vertically movable, marine working platform structure having vertically movable support frames according to the present invention.

A vertically movable, marine working platform structure A, which is also called "a float type marine working platform structure", consists of a working platform (deck) 1, support frames 2 for supporting the working platform 1, disc type foot members (foot cans) 3 attached to the lower ends of the support frames 2 and having a large area sufficient to uphold the working platform 1, support frames 2 and other members when the support frames 2 are grounded on the sea bottom, lift means (jacks) 4 for vertically moving the support frames 2 when the working platform 1 is floated on the surface of the sea, and vertically moving the working platform 1 when the support frames 2 are grounded on the sea bottom to set up the working platform structure, upper guides 5 provided in an upper portion of jack houses 7, which will be referred to later, and used to enable the working platform 1 or the support frames 2 to be moved in the vertical direction smoothly, lower guides 6 provided in the working platform 1, and enclosures (jack houses) 7 firmly fixed to an upper portion of the working platform 1, containing the upper guides 5 in upper portions thereof, and adapted to transmit the weights of the working platform 1 and other members to the lift means 4 in engagement with the support frames 2. The working platform 1 is provided in its lower surface recesses 8 large enough to hold the disc type foot members 3.

Each of the support frames 2 consists of a plurality of (four in the embodiment shown in FIGS. 1 and 2) cords 21 arranged vertically in parallel with one another, horizontal members 22 fixed between two adjacent cords 21, diagonal members 23 fixed between two horizontally adjacent horizontal members 22 and between two adjacent cords 21, panel point portions 24 where the horizontal members 22 and diagonal members 23 are joined to the cords 21, reinforcement members (not shown) for firmly fixing together the horizontal members 22, diagonal members 23 and cords 21, racks 25 vertically firmly fixed to the cords 21 and engageable with the lift means 4.

The panel point portions 24 are positioned at regular intervals in the vertical direction on each of the support frames 2. The lowermost panel point portions 24 are disposed in as close positions as possible with respect to the disc type foot members 3.

When the lowermost panel point portions 24 are disposed close to the disc type foot members 3, they can be held by the lower guides 6 provided in the working platform 1, in a case where the support frames 2 are fully jacked up to be held in the recesses 8 provided in the lower surface of the working platform 1. As a result, the stress occurring in the support frames can be scattered.

Figure 2:
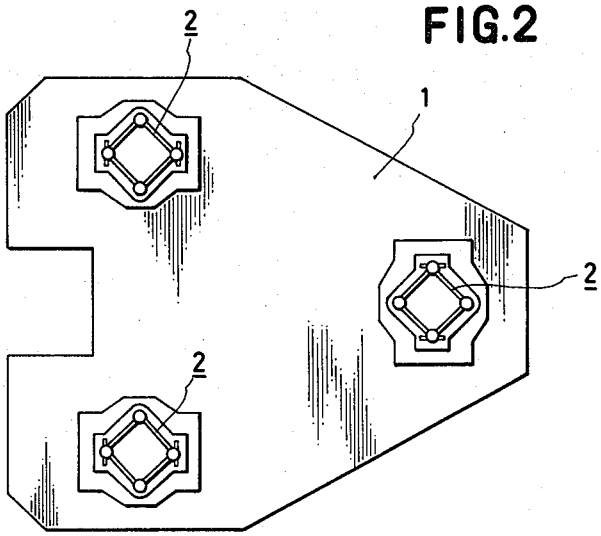
FIG. 2 is a plan view of the marine working platform structure shown in FIG. 1.
Figure 4:
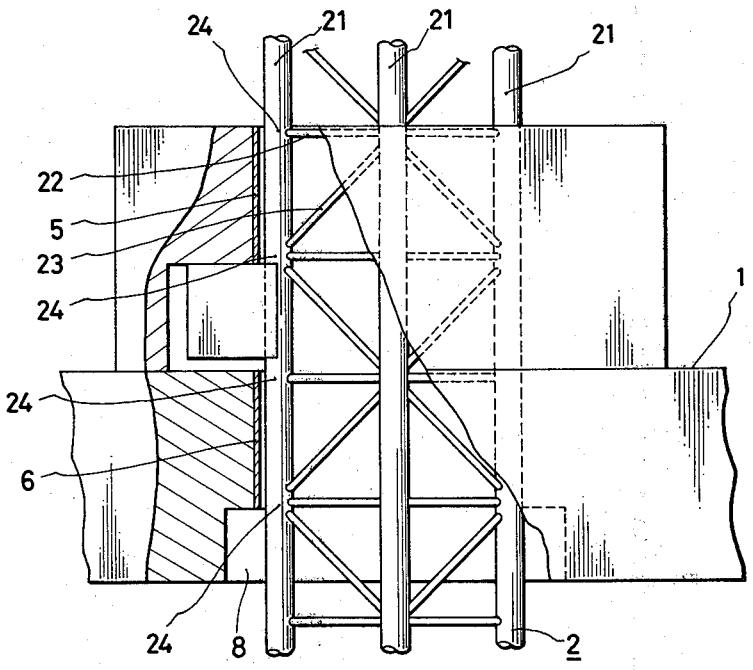
FIG. 4 is an enlarged side elevational view illustrating the engagement relationship between panel point portions of a support frame and support frame-holding guides.

As shown in FIGS. 1 and 4, the length of each of the upper guides 5 and lower guides 6 is equal to the distance between two vertically adjacent panel portions 24. Consequently, each of the guides necessarily includes in its length at least one panel portion 24 irrespective of the relative positional relationship between the upper guides 5, lower guides 6 and support frames 2. Thus, horizontal forces transmitted from the guide to the support frame can concentrate mainly on the panel point portion and can be born in substantially even portions by horizontal members and diagonal members, so that concentration of loads on a cord portion lying between two vertically adjacent panel point portions can be effectively prevented from occurring. The length of the guides 5, 6 may be somewhat greater than the distance between two vertically adjacent panel point portions.

For example, the stress occurring in a unit length of a support frame when a guide having a length according to the present invention is stopped in position where the length of the guide includes one panel point portion, and the stress occurring in a unit length of the same support frame when a conventional guide having a length smaller than the distance between two vertically adjacent panel point portions is stopped midway between two vertically adjacent panel point portions are calculated for trial. The results show that the former is several to several ten times as small as the latter.

Figure 3:
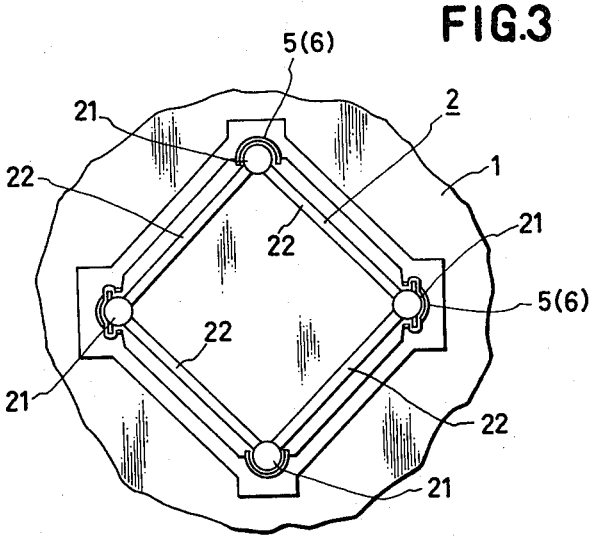
FIG. 3 is an enlarged plan view illustrating the engagement relationship between a support frame and a working platform.
Figure 5:
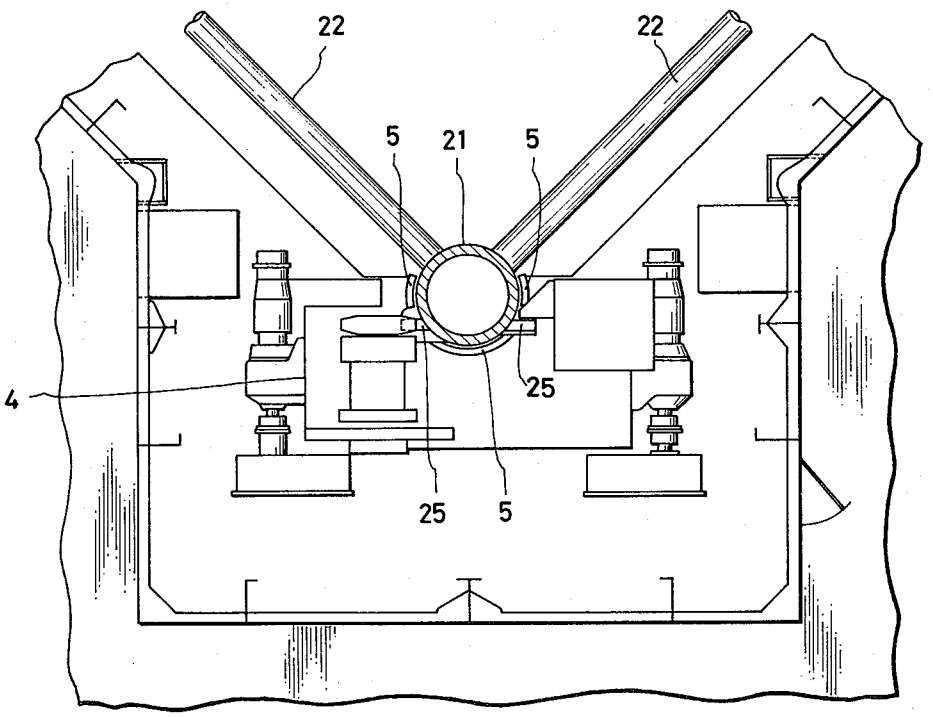
FIG. 5 is a plan view partially in section of a lift means for vertically moving the working platform.

The upper and lower guides 5, 6 are formed arcuately as shown in FIG. 3 and FIG. 5. The guides 5, 6, are preferably designed such as to embrace a cord 21 to as great an extent as possible without contacting the working platform 1 or the support frames 2 while they are vertically moved. Also the distance between the guides 5, 6 and the cords 21 is preferably set to as small a level as possible.

Figure 6:
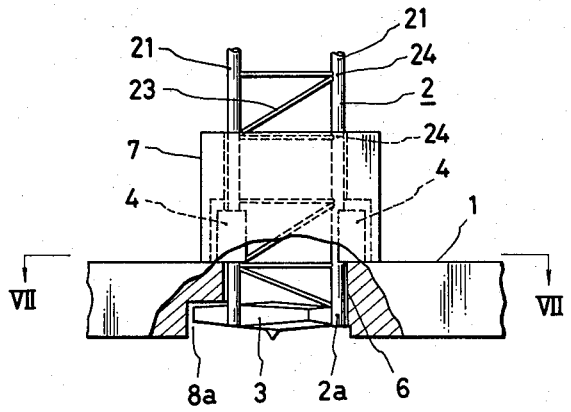
FIG. 6 is a side elevational view partially in section of another embodiment of the present invention.
Figure 7:
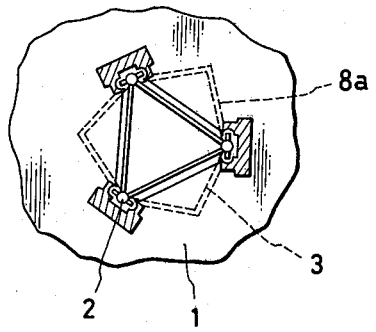
FIG. 7 is a sectional view taken along the line VII—VII in FIG. 6.

FIGS. 6 and 7 show another embodiment of the present invention. In this embodiment, cords 2 constituting a support frames are fastened to the side surfaces of a polygonal foot member 3, which serves as the lowermost horizontal members. The distance between panel point portions **2*a* where the polygonal foot member 3 is fastened to the cords 2, and panel point portions immediately above the panel point portions 2*a* is set equal to the distance between any of two vertically adjacent panel point portions. A working platform 1 is provided with recesses 8*a* in the lower surface thereof so as to hold the polygonal foot members 3 therein. Each of lower guides 6 is extended to a side wall of a recess 8*a* so that the panel point portions 2*a* to which the polygonal foot member 3 is fastened can be held by the lower guides 6. In the above arrangement, the lower guides 6, which are longer than lower guides used in a conventional marine working platform structure, can be held excellently within the working platform. Since the polygonal foot members 3 are held in the recesses 8*a*, no parts are projected downwardly from the lower surface of the working platform 1** so that the working platform structure can be advantageously subjected to dry towing using a barge.

Figure 8:
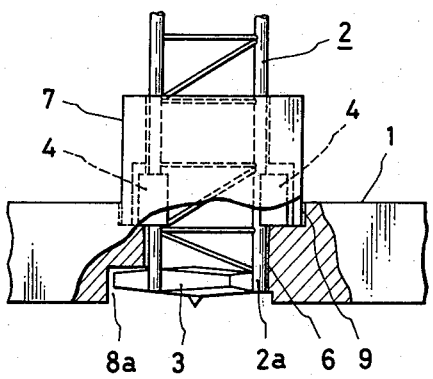
FIG. 8 is a side elevational view, partially in section, showing a further embodiment of the invention.

When the height or depth of the working platform 1 is so great as to be for example two times or exceeding two times the distance between two vertically adjacent panel portion 24, it may be devised, as shown in FIG. 8, to provide a recess 9 in an upper portion of the working platform 1 and dispose within the recess 9 the jack house 7 and lift means 4. In this example, it is feasible to make smaller the height between the lower end face of the working platform 1 and the upper end face of the jack house 7 and also make more or less smaller the weight of the working platform 1 itself, in comparison to the case in which the jack house 7 is mounted on the upper end surface of the working platform.

According to the present invention, the upper and lower guides are formed to a length at least greater than the distance between two vertically adjacent panel point portions, so that it can be made that horizontal forces can act mainly on the panel point portion and can be born in apportionment by respective cords through horizontal members and diagonal members.

In consequence, the stress the cord has to receive per unitary length between two longitudinally adjacent panel point portions thereof can be limited in the case according to the present invention only to such as being several to several ten times as small as that in the case of a short guide, that is, a guide of a length insufficient to extend between two longitudinally adjacent panel point portion of the cord.

Therefore, the weight of a support frame can be reduced to such an extent that corresponds to a decrease in stress occurring therein, by, for example, reducing the thickness of a cord. This allows the cost of manufacturing a working platform structure.

The present invention is not, of course, limited to the above embodiments; it may be modified in various ways within the scope of the appended claims.

What is claimed is:

1. A vertically moveable, marine working platform structure having vertically moveable, groundable support frames, comprising a working platform; a plurality of groundable support frames each of which consists of a plurality of cords arranged vertically in parallel with one another, a plurality of horizontal members both ends of each of which are joined to panel point portions of said cords, and a plurality of diagonal members both ends of each of which are joined to the panel point portions of said cords, and a plurality of diagonal members both ends of each of which are joined to the panel point portions of said cords, each of said support frames being vertically moveably fastened to said working platform; means mounted on said working platform for vertically moving each of said support frames, each such means being disposed partially in a recess provided in an upper surface portion of said working platform; and upper and lower support frame-holding guides provided in said working platform and having a length at least greater than the distance between two vertically adjacent panel point portions of said cords.

2. A vertically movable, marine working platform structure having vertically movable, groundable support frames according to claim 1, wherein said working platform is provided in its lower surface with recesses for holding therein foot members attached to the ends of said support frames.

3. A vertically movable, marine working platform structure having vertically movable, groundable support frames according to claim 1, wherein said support frames are fixed at their lower ends to side surfaces of said foot members such that those portions of said support frames which are fixed to the side surfaces of said foot members form panel point portions of said support frames, the distance between these panel point portions and panel point portions immediately above the same being set equal to the distance between any of two vertically adjacent panel point portions, each of lower guides being extended to a side wall of a recess adapted to hold therein a foot member attached to the end of each of said support frames.

4. A vertically movable, marine working platform structure having vertically movable, groundable support frames according to claim 1, wherein said foot members are sectionally polygonal.

* * * * *